US005094203A

United States Patent [19]

Mezger

[11] Patent Number: 5,094,203

[45] Date of Patent: Mar. 10, 1992

[54] RECIPROCATING ENGINE FOR A MOTOR VEHICLE

[75] Inventor: Hans Mezger, Freiberg, Fed. Rep. of Germany

[73] Assignee: Dr. Ing. h.c.F. Porsche AG, Fed. Rep. of Germany

[21] Appl. No.: 668,930

[22] Filed: Mar. 13, 1991

[30] Foreign Application Priority Data

Oct. 13, 1990 [DE] Fed. Rep. of Germany ..... 4032591

[51] Int. Cl.[5] ..... F02B 77/00

[52] U.S. Cl. ..... 123/198 R; 123/197.5

[58] Field of Search ..... 123/195 E, 198 R, 55 V, 123/55 VF, 55 VS, 55 VE, 197 R, 197 C

[56] References Cited

U.S. PATENT DOCUMENTS

| | | | |
|---|---|---|---|
| 1,173,105 | 2/1916 | Fekete | 123/55 V |
| 1,424,928 | 8/1922 | Vincent | 123/55 V |
| 2,182,290 | 1/1940 | Gordon et al. | 123/195 E |
| 3,418,994 | 12/1968 | Freyn | 123/195 R |
| 3,498,272 | 3/1970 | Roper | 123/198 R |

FOREIGN PATENT DOCUMENTS

| | | |
|---|---|---|
| 0095250 | 11/1983 | European Pat. Off. . |
| 1476021 | 3/1970 | Fed. Rep. of Germany . |
| 3635755 | 4/1987 | Fed. Rep. of Germany . |

OTHER PUBLICATIONS

Automobile magazine, ATZ 73, pp. 179–182, 5–1971.
Automobile magazine, ATZ 71, pp. 313–321, 9–1969.

*Primary Examiner*—Noah P. Kamen
*Attorney, Agent, or Firm*—Evenson, Wands, Edwards, Lenahan & McKeown

[57] ABSTRACT

In the case of a reciprocating engine of V-construction, a generator is arranged in the V-center. The outer walls of the engine power section bounding the V-cutout are adapted to the cylindrical housing of the generator and surround it at a radial distance.

6 Claims, 2 Drawing Sheets

RECIPROCATING ENGINE FOR A MOTOR VEHICLE

BACKGROUND AND SUMMARY OF THE INVENTION

The invention relates to a reciprocating engine for a motor vehicle with two cylinder banks arranged in a V-shape with a driving gear train originating from an engine crankshaft and leading to camshafts and to an engine clutch disposed in a center plane of the engine, and having a generator intended for the power supply of the engine and driven by the crankshaft.

This type of a reciprocating engine is known from the DE-Z Special Printing ATZ, Automobiltechnische Zeitschrift, 71st Year, No. 9/12/1969 and 73rd Year, No. 5/1971. An output shaft to the clutch driven by the crankshaft—viewed in the vertical direction of the vehicle—extends below the crankshaft and in parallel to it. It is driven by the crankshaft by way of a gearbox which is arranged in a center plane between the two crankshaft ends. The output shaft, also by way of a gearbox, drives the oil pumps arranged in the crankcase of the engine. A generator, which is screwed on top to the engine power section, is used for the electrical power supply of the engine.

It is an object of the invention to arrange the generator, which is constructed as a rotary current generator, on the engine power section in such a manner that a weight distribution of the engine can be achieved which is symmetrical with respect to the longitudinal axis of the engine, that the center of gravity of the engine is as low as possible, and that an operationally appropriate drive of the generator is promoted.

This object is achieved according to preferred embodiments of the invention by providing an engine arrangement wherein the generator is arranged in the V-center between the two banks of cylinders. If the generator is situated in the V-center, it is arranged symmetrically with respect to the longitudinal axis and contributes to a uniform distribution of the weight of the engine. Since, according to certain especially preferred embodiments, the generator is adapted to the outer walls of the V-cutout with a narrow radial distance, its point of gravity can have a minimal geodetic height. Because of its position, which is vertical above the crankshaft, it can be driven by directly by the crankshaft by means of constructively simple devices.

In especially advantageous preferred embodiments of the invention, the generator is driven by an intermediate shaft which is constructed as a spring torsion rod and is driven by the crankshaft while being disposed above it.

Other objects, advantages and novel features of the present invention will become apparent from the following detailed description of the invention when considered in conjunction with the accompanying drawings.

DETAILED DESCRIPTION OF THE DRAWINGS

Figure 1:
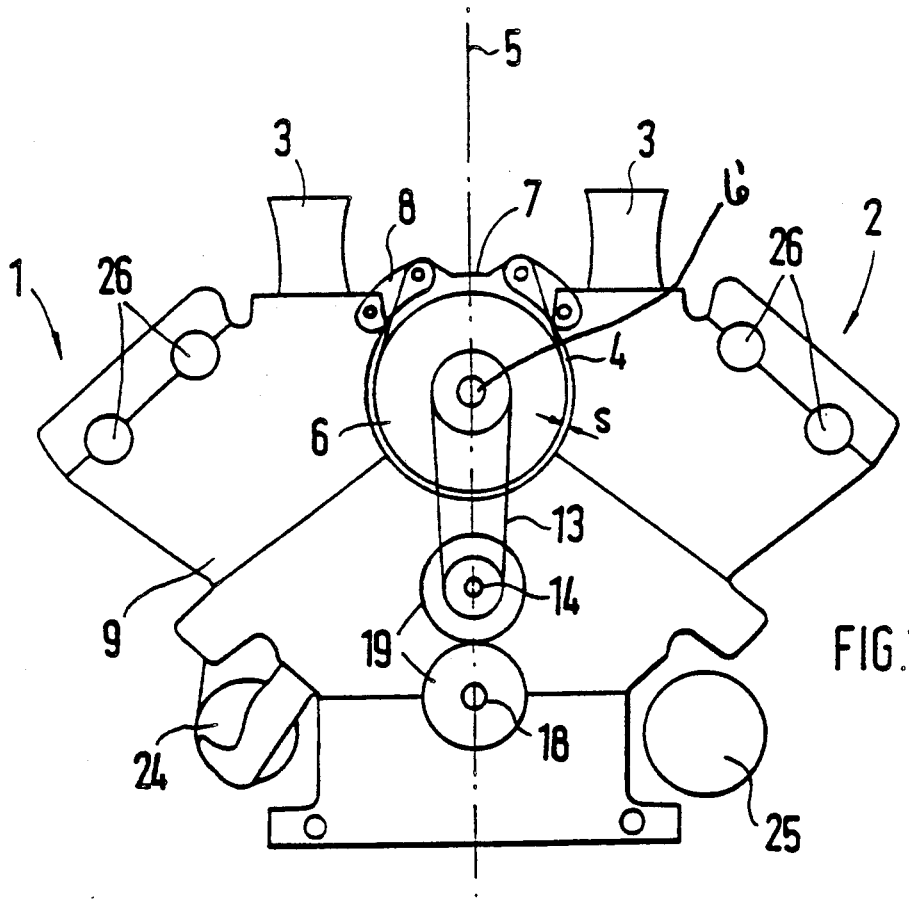
FIG. 1 is a front schematic view of a reciprocating engine constructed according to a preferred embodiment of the invention.
Figure 2:
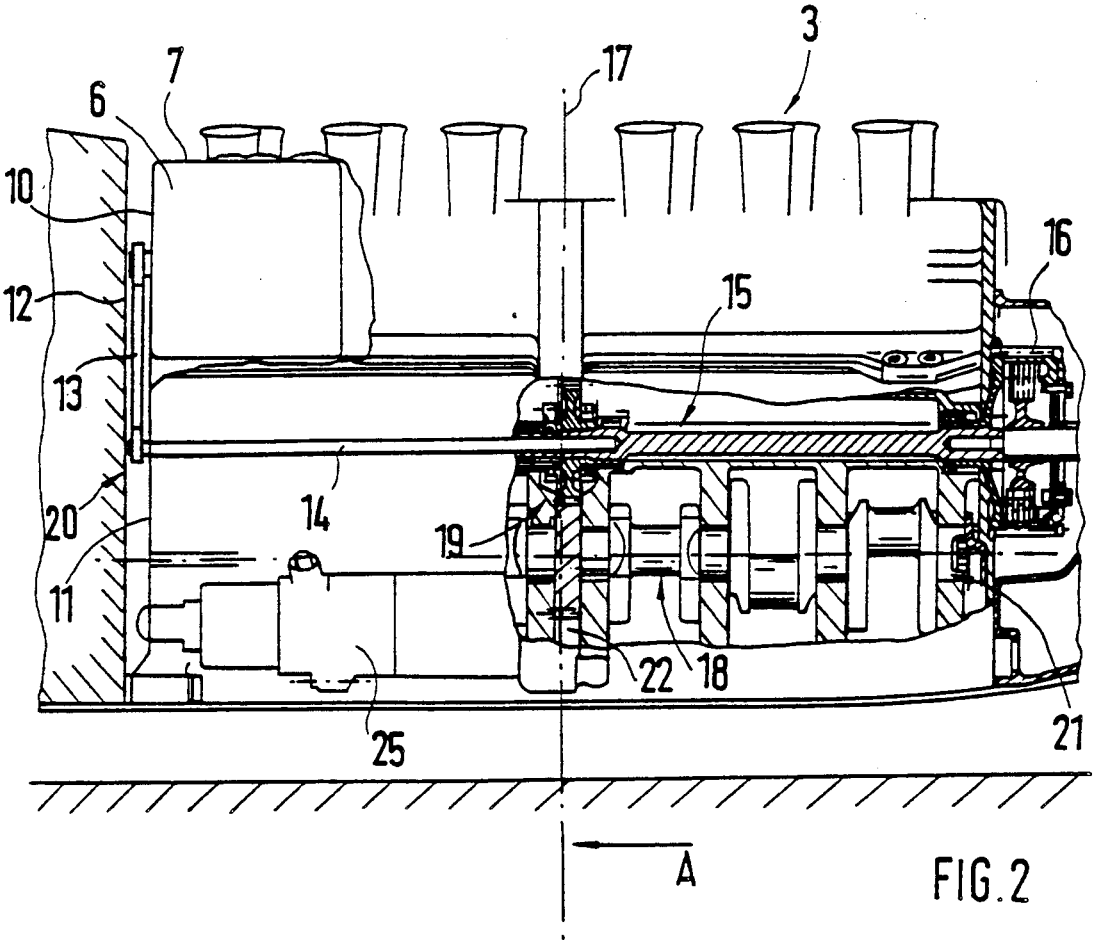
FIG. 2 is a schematic lateral view and a partial longitudinal sectional view of the reciprocating engine of FIG. 1.

A 12 cylinder reciprocating engine comprises two cylinder banks 1 and 2 having 6 cylinders respectively and arranged in a V-shape with respect to one another. A suction pipe tube 3 leads to each cylinder. A rotary current generator 6 is arranged in the V-cutout 4 in the V-center 5. The generator housing 7, by means of brackets 8—viewed in the driving direction A—is screwed to the right bank 1 of cylinders and the left bank 2 of cylinders. The outer walls of the cylinder heads of the engine power section 9, which bounds the V-cutout 4, are molded out cylindrically corresponding to the cylindrical housing 7 of the generator 6. They surround it at a radial distance s.

One end face 10 of the housing 7 of the generator 6 is flush with the forward end face 11 of the engine power section 9 which is disposed, at a narrow distance, opposite a transverse wall 12 of the vehicle body. A belt drive 13 leading from an intermediate shaft 14 to the shaft 6' of the generator 6 is arranged on the end faces 10 and 11. The intermediate shaft 14 is nonrotatably connected to an output shaft 15 driven by way of clutch 16. The output shaft 15 is driven by the crankshaft 18 by means of a gear set 19 located in the center plane 17. The center plane 17 is situated approximately in the center between the forward end 20 and the rearward end 21 of the crankshaft 18.

The transmission ratio of the crankshaft 18 to the output shaft 15 and of the intermediate shaft 14 to the shaft 6' of the generator 6 amounts to approximately 1:1 respectively so that the generator 6 rotates at approximately the same rotational speed as the crankshaft 18. If such a reciprocating engine is used as a racing engine, the maximal rotational speed of the crankshaft is at approximately 14,000 revolutions per minute. In order to keep the high torsional vibration amplitudes, which occur at such a high rotational speed, away from the generator 6, the intermediate shaft is constructed as a spring torsion rod so that jolts in the power transmission can be reduced. In addition, the vibrations are dampened by the belt drive 13.

By way of the output shaft 15, the left gear sets 22 and right gear sets, drive the right-hand pump unit 24 arranged on one longitudinal side of the engine power section and the left pump unit 25 arranged on the other longitudinal side of the engine. The pump units 24 and 25 each comprise a water pump, an oil suction pump and an oil pressure pump. Further details of the pump unit arrangements are included by reference to my co-pending, commonly assigned application Ser. No. 07/668,602, filed on even date herewith, and based on German Patent Application P 40 32 590.3, filed Oct. 13, 1990 in Germany.

Other gear sets, which are not shown and which are disposed in the center plane 17, drive the camshafts 26 of the left bank 2 of cylinders and of the right bank 1 of cylinders. Further details of the camshaft drive arrangements are included by reference to my co-pending commonly assigned application Ser. No. 07/669,011, filed on even date herewith, and based on German Patent Application P 40 32 593.8, filed Oct. 13, 1990 in Germany.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A reciprocating engine for a motor vehicle, with two cylinder banks arranged in a V-shape to form an engine power section, with a driving gear train originating from an engine crankshaft and leading to camshafts and to an engine clutch disposed is a center plane of the engine, and having a generator intended for the power supply of the engine and driven by the crankshaft, wherein the generator is arranged in the V-center between the two banks of cylinders, wherein the generator is driven by means of a belt drive by way of an intermediate shaft driven by the crankshaft, and wherein the intermediate shaft is arranged coaxially and non-rotatably with respect to a shaft which leads to a clutch, is driven by the crankshaft and extends in parallel to the crankshaft below the V-cutout.

2. A reciprocating engine according to claim 1, wherein outer walls of the engine power section bounding the V-cutout are configured to conform in shape to a cylindrical housing of the generator and surround said housing at a narrow radial distance.

3. A reciprocating engine according to claim 2, wherein an end face of the housing of the generator is approximately flush with a forward end face of the engine power section.

4. A reciprocating engine according claim 1, wherein the intermediate shaft is constructed as a spring torsion rod.

5. A reciprocating engine according to claim 1, wherein the intermediate shaft is constructed as a spring torsion rod.

6. A reciprocating engine according to claim 1, wherein a total of twelve cylinders are provided.

* * * * *